US008267358B1

(12) United States Patent
Letson

(10) Patent No.: US 8,267,358 B1
(45) Date of Patent: Sep. 18, 2012

(54) BAG HOLDER

(76) Inventor: Philip D. Letson, Phoenix, AZ (US)

( * ) Notice: Subject to any disclaimer, the term of this patent is extended or adjusted under 35 U.S.C. 154(b) by 0 days.

(21) Appl. No.: 13/104,201

(22) Filed: May 10, 2011

(51) Int. Cl.
*B65B 67/04* (2006.01)

(52) U.S. Cl. ..... 248/99; 248/97; 248/101; 294/214; 294/57

(58) Field of Classification Search ..... None
See application file for complete search history.

(56) References Cited

U.S. PATENT DOCUMENTS

| | | | | |
|---|---|---|---|---|
| 3,747,653 | A * | 7/1973 | Ringer | 383/12 |
| 4,193,157 | A | 3/1980 | Large | |
| 4,318,521 | A | 3/1982 | Martin et al. | |
| 4,768,742 | A * | 9/1988 | Kaaloa | 248/99 |
| 4,786,742 | A * | 11/1988 | Curzons | 549/414 |
| 4,787,584 | A * | 11/1988 | Palmer | 248/99 |
| 4,787,753 | A * | 11/1988 | Barnhart | 383/33 |
| 5,031,948 | A * | 7/1991 | Groth et al. | 294/214 |
| 5,106,041 | A * | 4/1992 | Jelincic | 248/99 |
| 5,588,622 | A | 12/1996 | Gordon, Sr. | |
| 5,836,553 | A * | 11/1998 | Bergaila | 248/99 |
| 6,431,503 | B1 * | 8/2002 | Horan | 248/101 |
| 6,450,461 | B1 | 9/2002 | Lohmann | |
| 6,517,034 | B1 * | 2/2003 | Kinchen | 248/99 |
| 7,007,991 | B1 * | 3/2006 | Sapp | 294/214 |
| 7,011,278 | B1 * | 3/2006 | Baldwin, III | 248/99 |
| 7,281,690 | B2 * | 10/2007 | Kelley | 248/97 |
| D605,372 | S | 12/2009 | Wilkinson | |
| 7,677,508 | B1 * | 3/2010 | Owens | 248/101 |
| 7,703,723 | B1 * | 4/2010 | Cooper et al. | 248/97 |
| 7,753,322 | B1 * | 7/2010 | Peterson | 248/99 |
| 7,833,062 | B2 * | 11/2010 | Zhou et al. | 439/620.23 |
| 7,975,732 | B2 * | 7/2011 | Schoniger | 141/316 |
| 2009/0289154 | A1 | 11/2009 | Gabriel | |
| 2010/0200709 | A1 * | 8/2010 | Wilkinson | 248/99 |
| 2010/0237203 | A1 * | 9/2010 | Romero | 248/99 |

* cited by examiner

*Primary Examiner* — Terrell McKinnon
*Assistant Examiner* — Monica Millner

(57) ABSTRACT

A bag holder is provided for holding a bag in an open position to facilitate collection of debris in the bag. The bag holder includes a rigid frame assembly having an outer frame and an inner frame. The outer frame has a perimeter wall. The inner frame is sized to nest within the perimeter wall of the outer frame. Thus, the frame assembly is configured for securing a bag between the outer frame and the inner frame such that the frame assembly holds the bag in an open position. A handle is coupled to and extends from the outer frame to facilitate manipulation of the open bag to a desired location using the handle. Debris may then be scooped or swept into the open bag.

11 Claims, 6 Drawing Sheets

BAG HOLDER

BACKGROUND OF THE DISCLOSURE

Field of the Disclosure

The disclosure relates to bag holding devices and more particularly pertains to a new bag holding device for holding a bag in an open position to facilitate collection of debris in the bag.

SUMMARY OF THE DISCLOSURE

An embodiment of the disclosure meets the needs presented above by generally comprising a rigid frame assembly having an outer frame and an inner frame. The outer frame has a perimeter wall. The inner frame is sized to nest within the perimeter wall of the outer frame. Thus, the frame assembly is configured for securing a bag between the outer frame and the inner frame such that the frame assembly holds the bag in an open position. A handle is coupled to and extends from the outer frame to facilitate manipulation of the open bag to a desired location using the handle. Debris may then be scooped or swept into the open bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
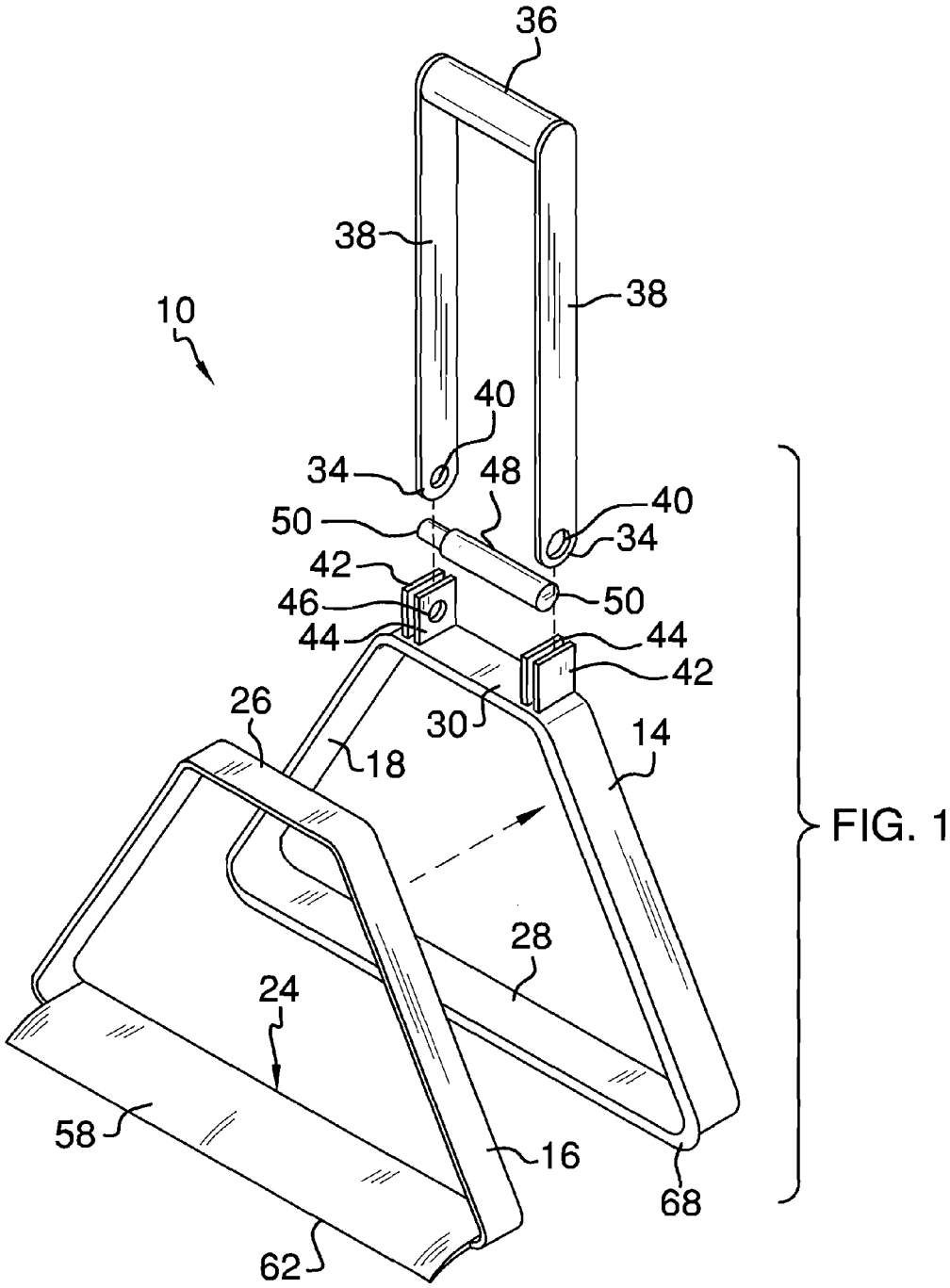
FIG. 1 is an exploded top front side perspective view of a bag holder according to an embodiment of the disclosure.
Figure 2:
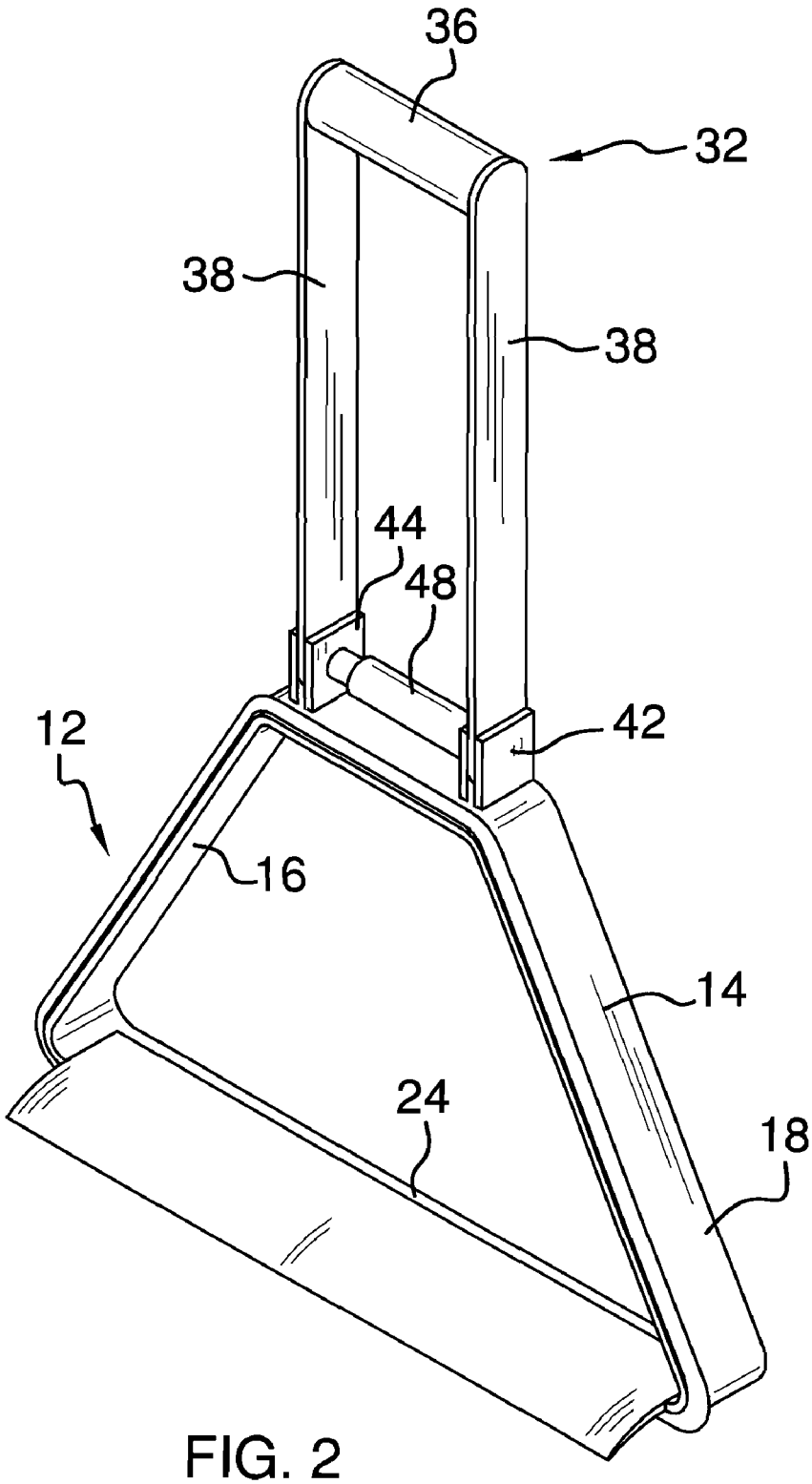
FIG. 2 is a top front side perspective view of an embodiment of the disclosure.
Figure 3:
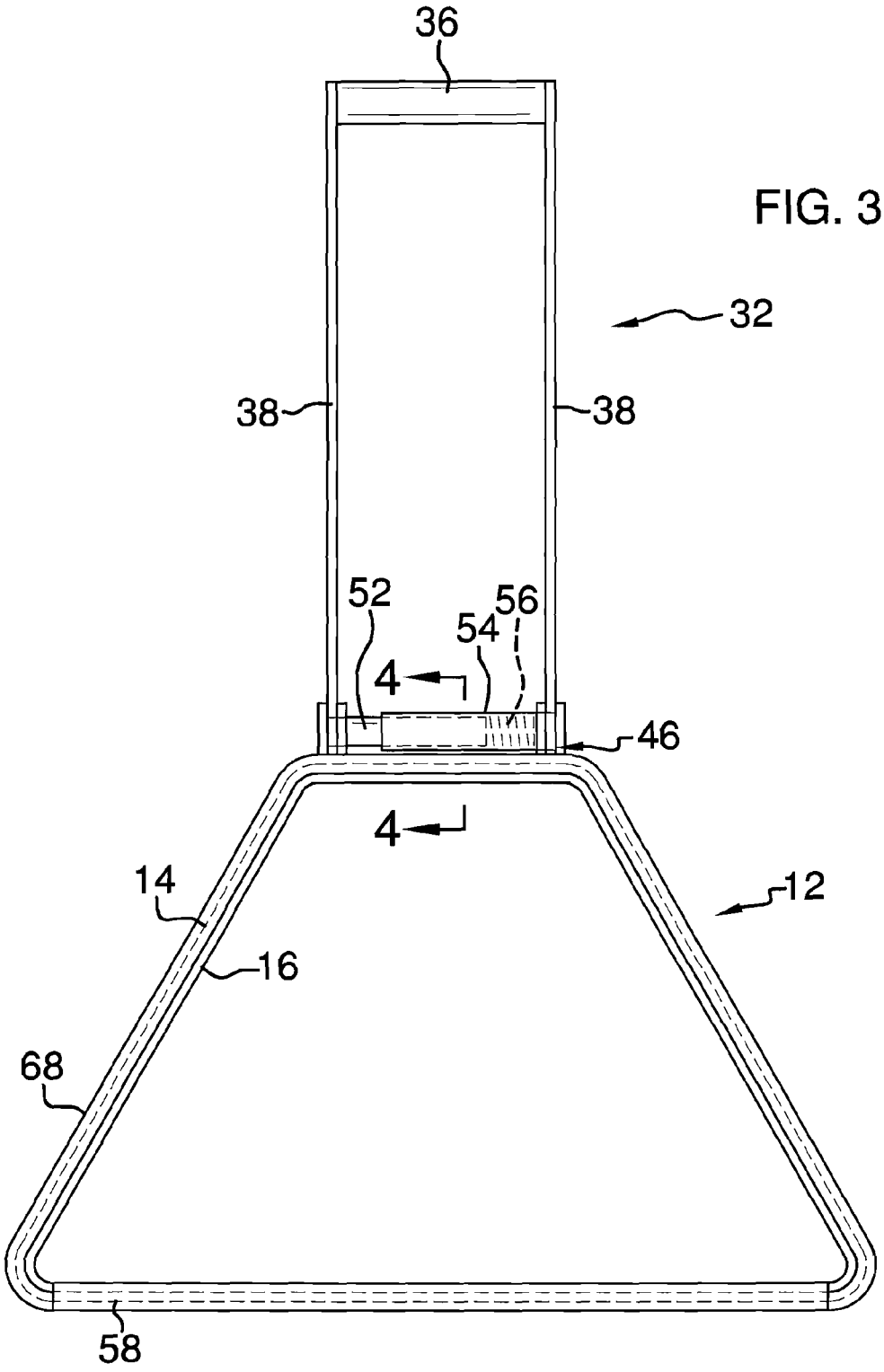
FIG. 3 is a front view of an embodiment of the disclosure.
Figure 4:
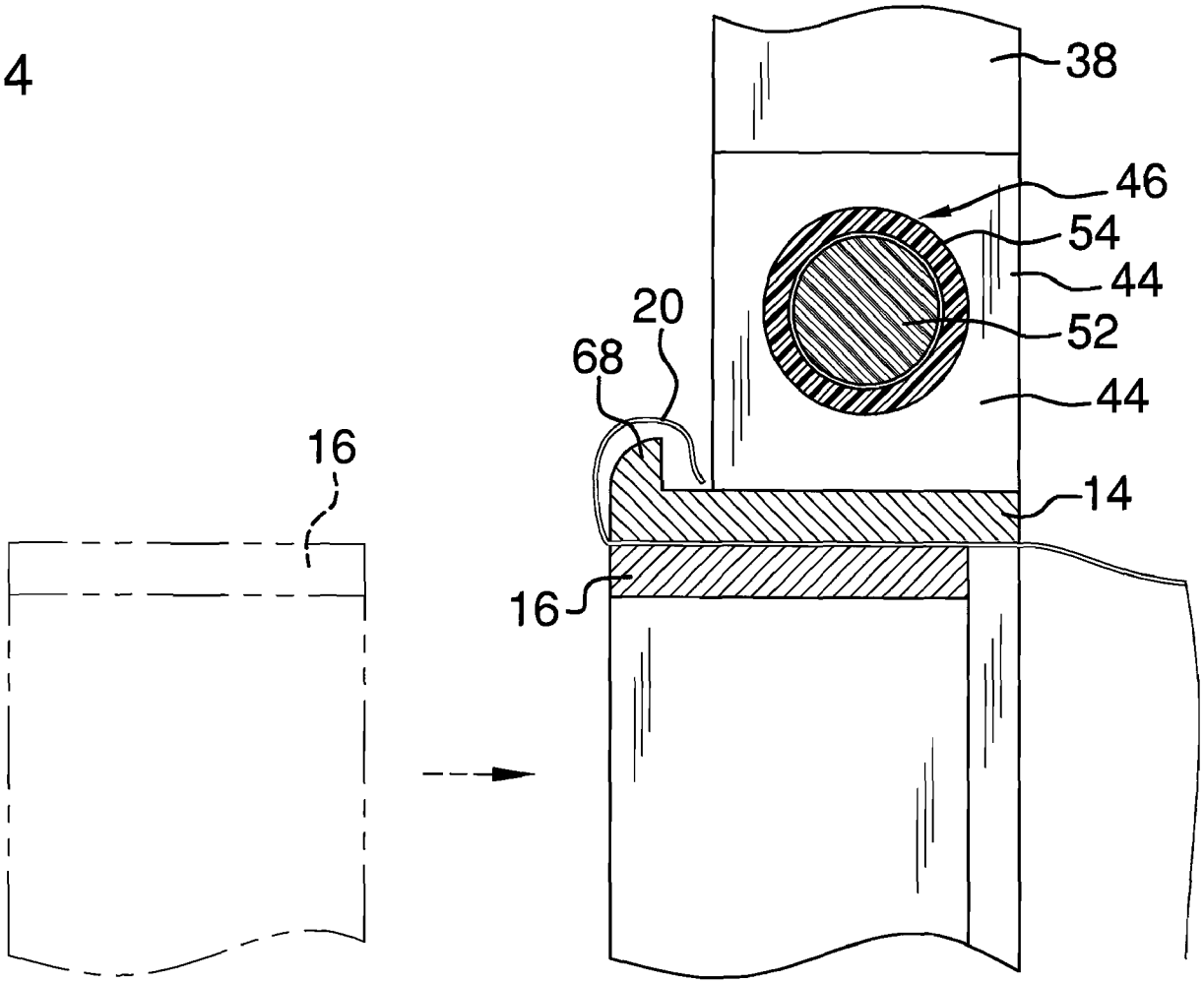
FIG. 4 is a cross-sectional view of an embodiment of the disclosure taken along line 4-4 of FIG. 3.
Figure 5:
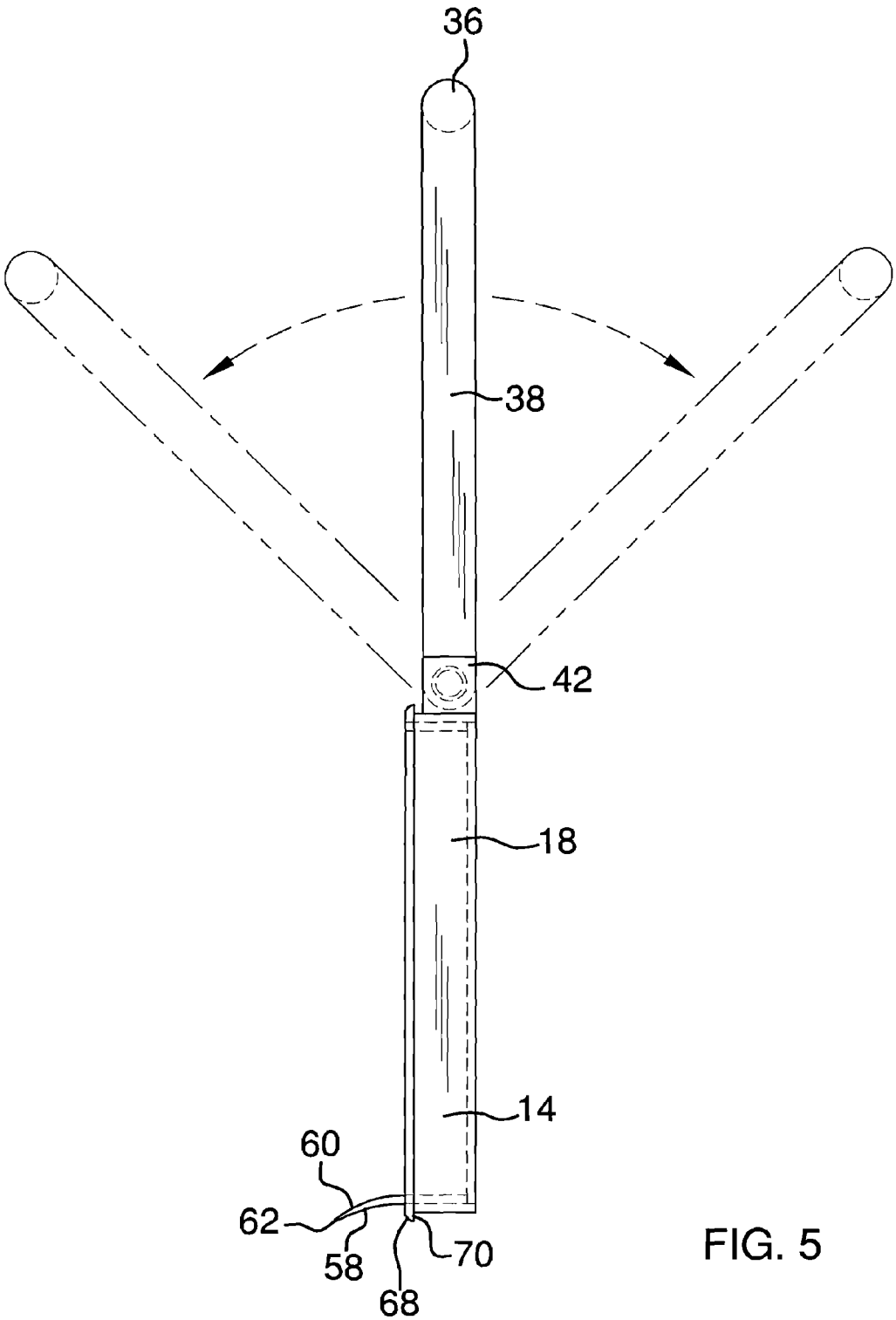
FIG. 5 is a side view of an embodiment of the disclosure.
Figure 6:
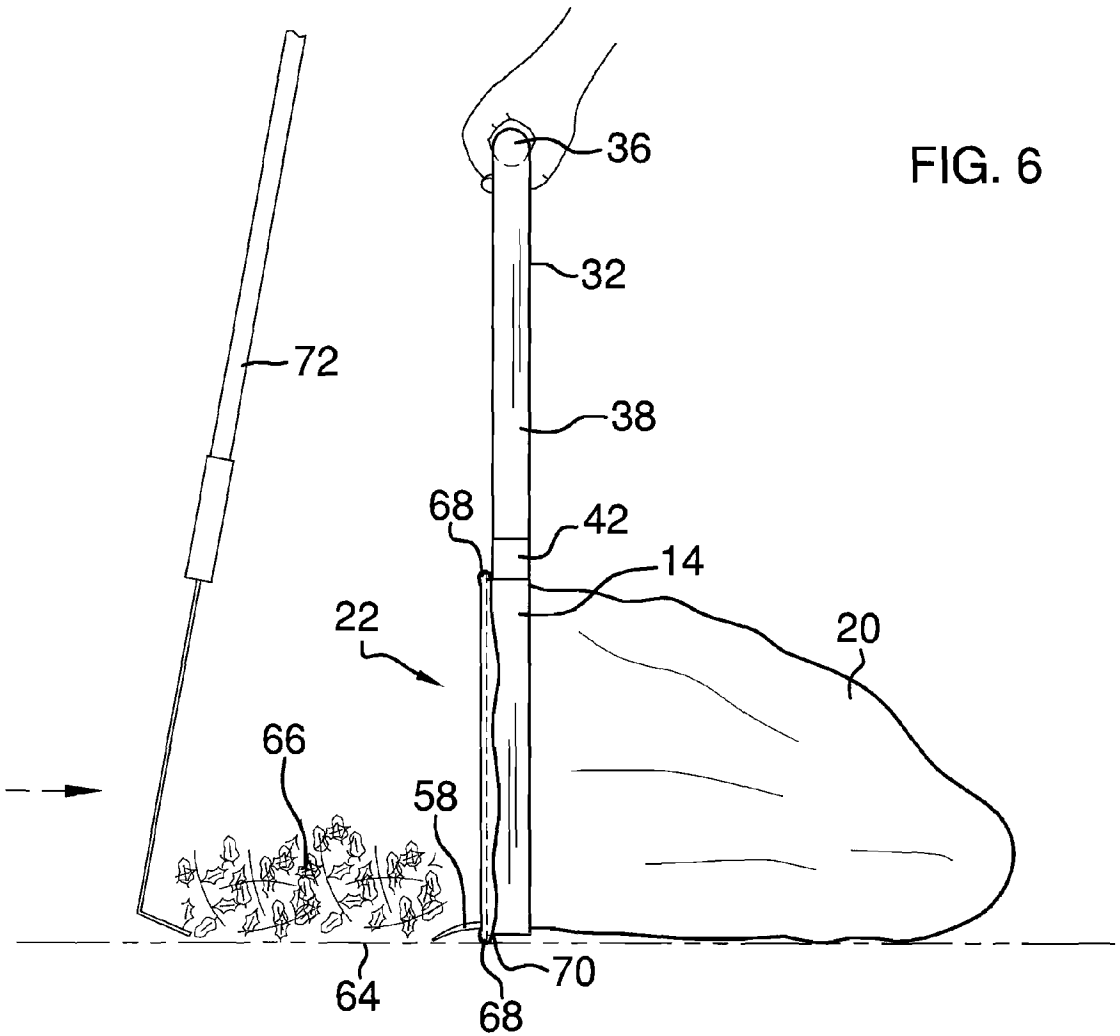
FIG. 6 is a side view of an embodiment of the disclosure in use.

With reference now to the drawings, and in particular to FIGS. 1 through 6 thereof, a new bag holding device embodying the principles and concepts of an embodiment of the disclosure and generally designated by the reference numeral 10 will be described.

As best illustrated in FIGS. 1 through 6, the bag holder 10 generally comprises a rigid frame assembly 12 has a trapezoidal outer frame 14 and a trapezoidal inner frame 16 with rounded corners and edges. The outer frame 14 has a perimeter wall 18. The inner frame 16 is sized to nest within the perimeter wall 18. Thus, the frame assembly 12 is configured for securing a bag 20 between the outer frame 14 and the inner frame 16 such that the frame assembly 12 holds the bag 20 in an open position 22. The inner frame 16 has a long side 24 and a short side 26. The short side 26 of the inner frame 16 is parallel to the long side 24 of the inner frame 16. Similarly, the outer frame 14 includes a long side 28 and a short side 30. The long side 28 of the outer frame 14 is parallel to the short side 30 of the outer frame 14.

A handle 32 is coupled to and extends from the outer frame 14. The handle 32 is coupled to the short side 30 of the outer frame 14 and has a pair of spaced free ends 34. A gripping portion 36 extends between side sections 38 of the handle 32. The free ends 34 are positioned on the side sections 38 and have aligned holes 40.

A pair of spaced parallel panels 42 is coupled to and extends from the short side 30 of the outer frame 14. A pair of spaced parallel plates 44 is also coupled to and extends from the short side 30 of the outer frame 14. The spaced plates 44 are positioned between the spaced panels 42. The spaced plates 44 have aligned apertures 46. The free ends 34 of the handle 32 may be positioned between the spaced panels 42 with the spaced plates 44 positioned between the free ends 34. A pin 48 is positioned between the spaced panels 42. Opposite ends 50 of the pin 48 are inserted through the aligned apertures 46 and the aligned holes 40. Thus, the handle 32 is pivotally coupled to the outer frame 14. The pin 48 may be a compression pin 48 whereby the pin 48 is compressible for removing the pin 48 and disengaging the handle 32 from the outer frame 14. The pin 48 has a first portion 52 and a second portion 54. The first portion 52 of the pin 48 is slidably inserted into the second portion 54 of the pin 48. A biasing member 56 is positioned in the second portion 54 of the pin 48. The biasing member 56 urges the first portion 52 of the pin 48 out of the second portion 54 of the pin 48 so that the opposite ends 50 of the pin 48 abut the spaced panels 42 locking the handle 32 in place.

An elongated scoop 58 is coupled to and extends from the long side 24 of the inner frame 16. The scoop 58 has a curved upper surface 60 extending to a leading edge 62 positionable on a ground surface 64 during use. The scoop 58 may extend along the full length of the long side 24 of the inner frame 16 to facilitate scooping of debris 66 into the bag 20 being held in the open position 22. A lip 68 may extend around the outer frame 14 from a forward edge 70 of the outer frame 14.

The circumference of the frame assembly 12 may be between 150 and 170 centimeters. The length of the scoop may be between 58 and 62 centimeters. The length of the short sides of the inner frame 16 and outer frame 14 may be between 14 and 16 centimeters.

In use, the inner frame 16 is inserted into the outer frame 14 with the bag 20 positioned between the outer frame 14 and the inner frame 16. The bag 20 is then held in the open position 22 by the frame assembly 12. If not previously attached, the handle 32 may be secured to the outer frame 14 using the pin 48. The handle 32 may then be employed to move the frame assembly 12 and bag 20 to a desired location and the scoop 58 positioned against the ground surface 64. A rake 72 or similar implement may be utilized to gather and sweep debris 66 into the bag 20. When the bag 20 is either full or no longer needed, the frame assembly 12 is removed from the bag 20 and the bag 20 may be closed and discarded with as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A bag holding assembly comprising:

a rigid frame assembly having an outer frame and an inner frame, said outer frame having a perimeter wall, said inner frame being sized to nest within said perimeter wall whereby said frame assembly is configured for securing a bag between said outer frame and said inner frame such that said frame assembly holds the bag in an open position;

a handle coupled to and extending from said outer frame;

a pair of spaced panels coupled to and extending from said outer frame;

a pair of spaced plates coupled to and extending from said outer frame, said spaced plates being positioned between said spaced panels, said spaced plates having aligned apertures;

said handle having a pair of spaced free ends, said free ends being positioned between said spaced panels and said spaced plates being positioned between said free ends, said free ends having aligned holes; and a pin positioned between said spaced panels, opposite ends of said pin being inserted through said aligned apertures and said aligned holes whereby said handle is pivotally coupled to said outer frame.

2. The assembly of claim 1, wherein said inner frame and said outer frame are trapezoidal.

3. The assembly of claim 2, wherein said handle is pivotally coupled to said outer frame.

4. A bag holding assembly comprising:

a rigid frame assembly having an outer frame and an inner frame, said outer frame having a perimeter wall, said inner frame being sized to nest within said perimeter wall whereby said frame assembly is configured for securing a bag between said outer frame and said inner frame such that said frame assembly holds the bag in an open position, said inner frame and said outer frame being trapezoidal, said outer frame including a long side and a short side, said long side being parallel to said short side;

a handle coupled to and extending from said outer frame, said handle being coupled to said short side of said outer frame;

a pair of spaced panels coupled to and extending from said short side of said outer frame;

a pair of spaced plates coupled to and extending from said short side of said outer frame, said spaced plates being positioned between said spaced panels, said spaced plates having aligned apertures;

said handle having a pair of spaced free ends, said free ends being positioned between said spaced panels and said spaced plates being positioned between said free ends, said free ends having aligned holes; and a pin positioned between said spaced panels, opposite ends of said pin being inserted through said aligned apertures and said aligned holes whereby said handle is pivotally coupled to said outer frame.

5. The assembly of claim 1, further including a scoop coupled to and extending from said inner frame.

6. The assembly of claim 4, further including said inner frame having a long side and a short side, said short side being parallel to said long side.

7. The assembly of claim 6, further including an elongated scoop coupled to and extending from said long side of said inner frame.

8. The assembly of claim 4, further including said pin being a compression pin whereby said pin is compressible for removing said pin and disengaging said handle from said frame.

9. The assembly of claim 1, further including a lip extending around said outer frame, said lip extending from forward edges of said outer frame.

10. The assembly of claim 8, further comprising:

said pin having a first portion and a second portion, said first portion being slidably inserted into said second portion of said pin; and a biasing member positioned in said second portion of said pin, said biasing member urging said first portion of said pin out of said second portion of said pin.

11. A bag holding assembly comprising:

a rigid frame assembly having a trapezoidal outer frame and a trapezoidal inner frame, said outer frame having a perimeter wall, said inner frame being sized to nest within said perimeter wall whereby said frame assembly is configured for securing a bag between said outer frame and said inner frame such that said frame assembly holds the bag in an open position, said inner frame having a long side and a short side, said short side of said inner frame being parallel to said long side of said frame, said outer frame including a long side and a short side, said long side of said outer frame being parallel to said short side of said outer frame;

a handle coupled to and extending from said outer frame, said handle being coupled to said short side of said outer frame, said handle having a pair of spaced free ends, said free ends having aligned holes;

a pair of spaced panels coupled to and extending from said short side of said outer frame;

a pair of spaced plates coupled to and extending from said short side of said outer frame, said spaced plates being positioned between said spaced panels, said spaced plates having aligned apertures, said free ends being positioned between said spaced panels and said spaced plates being positioned between said free ends; and a pin positioned between said spaced panels, opposite ends of said pin being inserted through said aligned apertures and said aligned holes whereby said handle is pivotally coupled to said outer frame, said pin being a compression pin whereby said pin is compressible for removing said pin and disengaging said handle from said frame, said pin having a first portion and a second portion, said first portion being slidably inserted into said second portion of said pin;

a biasing member positioned in said second portion of said pin, said biasing member urging said first portion of said pin out of said second portion of said pin;

an elongated scoop coupled to and extending from said long side of said inner frame; and a lip extending around said outer frame, said lip extending from a forward edge of said outer frame.

* * * * *